United States Patent [19]

Hall

[11] Patent Number: 4,555,413

[45] Date of Patent: Nov. 26, 1985

[54] PROCESS FOR PREPARING $H_2$ EVOLUTION CATHODES

[75] Inventor: Dale E. Hall, Wilton, Conn.

[73] Assignee: Inco Alloys International, Inc., Huntington, W. Va.

[21] Appl. No.: 636,707

[22] Filed: Aug. 1, 1984

[51] Int. Cl.[4] ..... B05D 1/00; B05D 1/08

[52] U.S. Cl. ..... 427/34; 427/123; 427/376.6; 427/423

[58] Field of Search ..... 427/34, 123, 423, 376.6

[56] References Cited

U.S. PATENT DOCUMENTS 4,279,709 7/1981 McIntyre et al. ..... 427/423 X
4,328,285 5/1982 Siemers et al. ..... 427/34 X
4,331,528 5/1982 Beer et al. ..... 427/423 X
4,342,792 8/1982 Brown et al. ..... 427/34
4,421,799 12/1983 Novinski ..... 427/423
4,473,454 9/1984 Asano et al. ..... 427/34 X

*Primary Examiner*—Thurman K. Page
*Attorney, Agent, or Firm*—Francis J. Mulligan, Jr.; Raymond J. Kenny

[57] ABSTRACT

A process for preparing hydrogen evolution cathodes comprises plasma spraying or flame spraying $AB_5$ intermetallic compound powder alone or in association with nickel, nickel alloy or iron powder onto a steel or nickel substrate and thereafter reducing the sprayed substrate at a temperature of up to about 650° C.

6 Claims, No Drawings

PROCESS FOR PREPARING $H_2$ EVOLUTION CATHODES

The present invention is concerned with the preparation of hydrogen evolution cathodes and more particularly with the preparation of hydrogen evolution cathodes employing an $AB_5$ intermetallic compound as an electrocatalyst. The cathode made by the process of the present invention is useful in the electrolysis of aqueous alkaline electrolytes.

PRIOR ART AND BACKGROUND OF INVENTION

There is disclosed in European patent specification No. 89141A of Sept. 21, 1983 a cathode having a nickel or nickel-coated iron substrate and a catalytically active coating containing a powder mixture of an intermetallic $AB_5$ compound and nickel. The coating was applied from an aqueous polysilicate slurry and was sintered in hydrogen to create a metallurgical bond to the substrate. This cathode exhibits excellent electrocatalytic activity. However, the following drawbacks were encountered during manufacture of cathodes of industrial size. First manufacturing costs were high, primarily because of the high temperature, hydrogen atmosphere sintering step. Secondly, the cathode substrate was extremely soft after heat treatment. Finally, the high sintering temperatures and times required to produce a coating with good abrasion resistance had an adverse effect on catalytic activity.

In U.S. Pat. No. 4,410,413 it is disclosed that a non-spinel oxide is formed in a plasma sprayed coating of nickel on an electrode substrate and that this non-spinel oxidic coating has good electrocatalytic properties for evolution of hydrogen when it is exposed in situ to cathodically produced hydrogen.

OBJECT OF THE INVENTION

It is the object of the invention to produce a useful hydrogen evolution cathode employing in the process of production an $AB_5$ intermetallic compound.

DESCRIPTION OF THE INVENTION

The present invention contemplates a process for producing a hydrogen evolution cathode comprising spraying particles of powder containing an $AB_N$ intermetallic compound through an energetic medium onto a metallic substrate. This metallic substrate is characterized by corrosion resistance in aqueous alkaline media. The duration of the spray passage and the temperature of said medium are such that particles of said powder are at least partly molten at the time of impact of the powder with the substrate. Thereafter the thus sprayed substrate is subjected to a reduction, e.g., in a reducing gas at a temperature up to about 650° C. to reduce the coating on said substrate.

The $AB_N$ compound used in preparation of the cathode of the present invention contains

- as A one or more members of the group consisting of rare earth elements and calcium which can be replaced in part, e.g., up to about 0.2 atom by zirconium or thorium or both.
- as B nickel and/or cobalt which may be replaced in amounts up to about 1.5 atom by aluminum, copper, tin, iron and/or chromium, and is characterized in that the subscript N has a value generally between 4 and 8. Advantageously the value of subscript N is about 5. However, when as is advantageous, intermetallic compounds involving rare earths and nickel are used, the $AB_5$ compound may be associated with other material such as $A_2Ni_{17}$ or nickel. Such compounds in such association are useful and included within the scope of the present invention. Advantageously relatively pure materials such as $MMNi_5$ (MM=mischmetal), $LaNi_5$ and $LaNi_{4.7}Al_{0.3}$ are the electrocatalytic material used in preparation of the cathodes of the present invention.

It is also preferred to use as the $AB_5$ phase compounds of lanthanum or other rare earth metal with nickel in which up to 1.5 of the 5 atoms is replaced by aluminum or copper. Another preferred composition for use is $CaNi_5$.

Rare earths used in the $AB_5$ compound in preparing cathodes of the present invention are conveniently in the form of relatively inexpensive mixtures such as mischmetal (MM) or cerium-free mischmetal (CFM). Compositions in weight percent, of commonly available grades of these mixtures are set forth in Table I.

TABLE I

| Element | MM | CFM |
|---|---|---|
| Ce | 48–50 | about 0.8 |
| La | 32–34 | about 61.6 |
| Pr | 4–5 | about 9.2 |
| Nd | 13–14 | about 28.5 |

In addition to the $AB_N$ powder in material to be sprayed, one can include other particulate metal such as nickel, iron, nickel alloy etc., in an amount up to about 65% of the weight of total sprayable powder. Furthermore one can also include material which will dissolve in water, in dilute acid or in aqueous alkali in the sprayable mixture to provide porosity in the sprayed deposit.

Nickel powder which may optionally be present in the sprayable powder to form a hydrogen evolution cathode can be a powder produced by the thermal decomposition of nickel carbonyl. Various grades of such nickel powders are commercially available and exhibit a variety of particle size and shape characteristics. Grades of nickel powder sold by INCO Limited of Toronto, Ontario, Canada which can be used include 123, 287 and 255. More preferably however, nickel powders especially suited for plasma spraying are employed in the process of the present invention. Operable sprayable nickel powder include those provided by Metco, Inc. of Westbury, N.Y. under the designations 56F-NS,56 C-NS, and XP-1104. A suitable nickel-aluminum alloy powder is provided by Metco, Inc. under the designation 450. Sprayable iron (including steel) powder is readily available commercially.

Materials which can be employed to form porosity in the sprayed coating include thermally stable inorganic salts, e.g., sodium chloride potassium chloride, sodium fluoride, etc.—soluble in water; thermally stable oxides not readily forming insoluble species, e.g., calcium oxide, magnesium oxide, etc.—soluble in water or dilute acid and; stable acidic materials e.g., silica, alumina—soluble in strong, hot aqueous alkali solution. If pore-forming materials are used, it is to be observed that mixtures should be avoided which upon reaction are likely to produce insoluble products, e.g., mixtures of magnesia and silica.

The substrates employed in the process of the present invention can be nickel, nickel/iron alloy, steel, steel coated with nickel or other commonly used cathode materials. Preferred substrate forms are woven screen, expanded metal, porous, foamed or other foraminous forms, as well as metal sheet. The substrates must be clean and preferably sand-blasted or etched to provide a surface to which sprayed metal particle will adhere.

As used in this specification and claims, the term "spraying through an energetic medium" is employed as generic to the known processes of flame spraying and plasma spraying and any equivalent means whereby solids are caused to become at least semi-molten and to impact on and adhere to a suitable substrate. In practicing the present invention, it is advantageous to employ plasma spraying. Each of the cathodes prepared as test pieces and discussed hereinafter were prepared by plasma spraying with a METCO TM FM commercial plasma spraying system using a gas mixture containing about 100 parts by volume of argon and 5 parts by volume of hydrogen. Metal powder was sprayed through the gas energized by a 400 ampere, 55 volt arc for a distance of about 10 cm to the substrate being coated. Coatings of $AB_N$-containing powders on substrates for purposes of the present invention need be of no greater thickness than about 75 μm. Thicker coatings will work as precursor hydrogen evolution catalyst material but are more expensive than thinner coatings without giving any electrochemical advantage vis-a-vis thinner coatings. Coatings thinner than 50 μm can be used but are difficult to produce in a controlled manner.

After the substrate is spray coated, the thus modified substrate is subjected to allow temperature reduction in a flowing reducing gas, e.g., hydrogen or hydrogen-inert gas mixtures. For purpose of the test work reported in the example hereinafter satisfactory reductions were conducted in essentially atmospheric pressure hydrogen at least about 300° C. for thirty minutes, with 500° C. being an optimum temperature for this period of time. Those skilled in the art will appreciate that optimum results in terms of lowering over potential for electrochemical evolution of hydrogen can be produced using shorter reduction times at higher temperatures and longer reduction times at lower temperatures. As a caution in selecting reduction conditions one should not exceed a temperature of about 1010° C. because above this temperature $AB_N$ compound tends to break down at the surface and provide less than maximum electrocatalytic effect. Electrode characteristics can also be modified by employing various mixtures of hydrogen with inert gasses as the reducing agent.

EXAMPLES OF THE BEST MODE OF CARRYING OUT THE INVENTION

EXAMPLE I

Plasma sprayed coatings were prepared from −325 mesh $LaNi_{4.7}Al_{0.3}$ powder, using a METCO TM IM commercial plasma spraying system. The coatings were applied to mild steel woven wire screen, nickel-plated steel woven wire screen, and mild steel sheet. Optical microscopy of polished coating cross sections showed typical plasma sprayed coating structure, i.e., coating particles were flattened, interlocked, and arranged in a roughly lamellar pattern. Dark regions in the coatings indicated that substantial oxidation of the $LaNi_{4.7}Al_{0.3}$ had occurred. Cathodes as listed in Table II were produced.

TABLE II

| Cathode No. | Substrate Type |
|---|---|
| 370-A | nickel-plated steel screen |
| 370-B | nickel-plated steel screen |
| 370-C | nickel-plated steel screen |
| 370-E | mild steel screen |
| 370-G | mild steel screen |
| 370-H | mild steel screen |
| 358-A-5 | steel sheet |
| 358-C-12 | steel sheet |

Cathodes employing a nickel-plated steel screen as a substrate and a mild steel screen as substrate were used for test purposes. One cathode of each type was used as sprayed. A second was reduced for 30 minutes at 300° C., while the third was reduced for 30 minutes at 500° C. each reduction being carried out in a tank hydrogen atmosphere.

The cathodes were tested in 30% KOH electrolyte at 80° C. A constant current density of 200 mA/cm$^2$ was imposed on the cathodes. Overpotentials were measured at regular intervals against in the tests. Overpotentials were corrected for ohmic resistance and electrode resistance factors for each electrode were calculated by computor.

Electrochemical testing was carried out for 150–175 hours. Over the last 50 hours of testing, the average iR-free overpotentials set forth in Table III were measured.

TABLE III

| Cathode No | T red, °C. | $\eta H_2$, V | R, Ω-cm$^2$ |
|---|---|---|---|
| Mild Steel Screen Substrates | | | |
| 1 | — | 0.170 | 0.32 |
| 2 | 300 | 0.110 | 0.32 |
| 3 | 500 | 0.115 | 0.24 |
| Nickel-plated Steel Screen Substrates | | | |
| 4 | — | 0.180 | 0.26 |
| 5 | 300 | 0.125 | 0.24 |
| 6 | 500 | 0.093 | 0.20 |

Table III shows clearly that thermal reduction under $H_2$ markedly improves the efficiency of the plasma-sprayed $AB_5$ cathodes. In addition, the table shows the resistance factor, R, which was determined by computer correction of ohmic resistance, for each cathode. Because the geometry and components of all cells were otherwise identical, a decreasing R value is indicative of lower internal cathode resistance, indicating that thermal reduction made the cathode coatings more conductive. (For uncoated nickel cathodes, R is typically about 0.17Ω-cm$^2$ in the test cells used.) Scanning electron microscopy of the coatings on steel showed normal plasma sprayed structures. There was no observable difference in structure between as-sprayed and reduced coatings.

EXAMPLE II

Cathodes were prepared by spraying powders as set forth in Table IV onto mild steel screens.

TABLE IV

| Cathode No. | Powder (Wt. %) | Area (cm$^2$) | Coating Wt. (g) | Load (g/m$^2$) |
|---|---|---|---|---|
| 8 | 100% $LaNi_{4.7}Al_{0.3}$ | 240 | 17 | 708 |
| 9 | 70% $LaNi_{4.7}Al_{0.3}$ 30% Metco TM 56FNS | 236 | 23.5 | 996 |
| 10 | 70% $LaNi_{4.7}Al_{0.3}$ | 248 | 9 | 363 |

TABLE IV-continued

| Cathode No. | Powder (Wt. %) | Area ($cm^2$) | Coating Wt. (g) | Load ($g/m^2$) |
|---|---|---|---|---|
| | 30% Metco TM 450 | | | |

Coatings on cathodes 8 and 9 were thicker than optimal.

Samples of cathodes 8 to 10 were run in aqueous alkali for 152 to 172 hours (or 250–260 hours as indicated) under hydrogen evolution conditions i.e., a cathode current density of 200 m $A/cm^2$ in 30 weight percent aqueous KOH at 80° C. Results in terms of overpotential are set forth in Table V for both unreduced plasma sprayed substrates and plasma sprayed substrates reduced in flowing hydrogen for 30 minutes at the temperature indicated.

TABLE V

| Sample No. | Red. Temps. (°C.) | $\eta H_2$ (V) at time in hours | | | | |
|---|---|---|---|---|---|---|
| | | 0 | 30 | 100 | 150 | |
| | | Cathode 8 | | | | |
| 1 | no reduction | 0.264 | 0.182 | 0.154 | 0.172 | |
| 2 | 300 | 0.200 | 0.151 | 0.138 | 0.154 | |
| 3 | 500 | 0.187 | 0.131 | 0.115 | 0.122 | |
| 4 | 700 | 0.218 | 0.146 | 0.138 | 0.148 | |
| | | 0 | 50 | 150 | 200 | 250 |
| | | Catbode 9 | | | | |
| 1 | no reduction | 0.238 | 0.124 | 0.127 | 0.103 | 0.115 |
| 2 | 300 | 0.193 | 0.137 | 0.134 | 0.108 | 0.128 |
| 3 | 500 | 0.181 | 0.126 | 0.138 | 0.110 | 0.120 |
| 4 | 700 | 0.238 | 0.168 | 0.184 | — | 0.174 |
| | | 0 | 30 | 100 | 150 | 260 |
| | | Cathode 10 | | | | |
| 1 | no reduction | 0.259 | 0.183 | 0.189 | 0.172 | 0.181 |
| 2 | 300 | 0.184 | 0.108 | 0.134 | 0.128 | 0.150 |
| 3 | 500 | 0.148 | 0.127 | 0.133 | 0.124 | 0.123 |
| 4 | 700 | 0.227 | 0.187 | 0.185 | 0.171 | 0.187 |

Weight losses over the lifetime of the various tests and resistance factors for cathodes 8, 9 and 10 are set forth in Table VI.

TABLE VI

| Cathode Sample No. | Wt. Loss % of orig. Coating | Resistance (Ω-cm2) |
|---|---|---|
| 8-1 | 8.5 | 0.39 |
| 8-2 | 4.0 | 0.27 |
| 8-3 | 4.0 | 0.25 |
| 8-4 | 3.7 | 0.28 |
| 9-1 | 3.9 | 0.27 |
| 9-2 | 1.4 | 0.26 |
| 9-3 | 1.1 | 0.22 |
| 9-4 | 1.3 | 0.25 |
| 10-1 | 5.2 | 0.23 |
| 10-2 | 7.7 | 0.22 |
| 10-3 | 7.4 | 0.27 |
| 10-4 | 4.7 | 0.22 |

Tables V and VI show that with the exception of cathode 10-2, all cathode samples showed stable operating potentials after an initial break-in period. Cell resistance factors were generally flat vs. time. For cathode types 8 and 10, hydrogen reduction at 500° C. produced the best overpotential results type 8 cathodes worked well under all conditions except reduction at 700° C. For all three cathode types 8, 9 and 10 lowest resistance factors generally were achieved with samples subjected to reduction at 500° C. Optimum cathodes of each type were about equally efficient, indicating that expensive catalyst can be mixed with cheaper material without adverse effects. All $H_2$ reduced cathodes showed low weight loss. Type 9, as sprayed, also showed low weight loss. Thus the reduction step improved strength. The use of METCO TM 450 nickel known to the plasma spray art as a "bond coat" material also improved the strength of the catalyst layer on the substrate.

EXAMPLE III

Substrates which were plasma sprayed comprised nominally 15.2 cm × 15.2 cm nickel plated steel (Ni-ply) screens. Before plasma spray coating, substrates were sandblasted and etched in 10% aqueous HCl. Powders which were sprayed are set forth in Table VII.

TABLE VII

| Coating Type | Powder | Coating WT. g | Coating Load, $g/m^2$ |
|---|---|---|---|
| 11 | $LaNi_{4.7}Al_{0.3}$ (−325 mesh) | 10.4 | 448 |
| 12 | 80% $LaNi_{4.7}Al_{0.3}$ 20% METCO 56F-NS | 9.8 | 422 |
| 13 | 60% $LaNi_{4.7}Al_{0.3}$ 40% METCO 56F-NS | 11.1 | 478 |
| 14 | 40% $LaNi_{4.7}Al_{0.3}$ 60% METCO 56F-NS | 8.3 | 357 |
| 15 | 80% $LaNi_{4.7}Al_{0.3}$ 20% METCO 450 | 9.4 | 405 |
| 16 | 60% $LaNi_{4.7}Al_{0.3}$ 40% METCO 450 | 12.9 | 555 |
| 17 | 40% $LaNi_{4.7}Al_{0.3}$ 60% METCO 450 | 10.2 | 439 |
| 18 | 80% $CaNi_5$, 20% METCO 56F-NS | 8.8 | 379 |
| 19 | 80% $MMNi_5$, 20% METCO 56F-NS | 9.4 | 405 |
| 20 | 80% $MMNi_{4.5}Al_{0.5}$ 20% METCO 56F-NS | 10.2 | 439 |
| 21 | 80% $M^*Ni_{4.15}Fe_{.85}$, 20% METCO 56F-NS | 14.2 | 611 |

*MM = mischmetal

Each of the coated screens 11 to 12 was cut into from equal squares, numbers 1–4. These were treated as follows: Those squares designated "1" were given no heat treatment. Those squares designated "2" were subjected to flowing hydrogen at 300° C. for 30 minutes: Those squares designated "3" were subjected to flowing hydrogen at 500° C. for thirty minutes and: Those squares designated "4" were subjected to flowing hydrogen at 700° C. for thirty minutes. Each series of cathodes 11 to 21 was tested at 200 $mA/cm^2$ in polypropylene type I test cells. Electrolyte was 30 w/o KOH at 50° C. Cathode potential was measured and average overpotential and resistance factors were calculated. Weight loss was also determined. Set 20 was tested in another test cell under the same conditions. However, only total cell voltages were determined. Results of these tests are set forth in Table VII and IX.

TABLE VIII

| Cathode | Test Time (Hours) | $\eta H_2V$ | R($\Omega/cm^2$) | Wt. Loss (mg) |
|---|---|---|---|---|
| 11-1 | 198 | 0.17 | 0.24 | 28.4 |
| 11-2 | 198 | 0.15 | 0.22 | 15.0 |
| 11-3 | 198 | 0.13 | 0.23 | 13.9 |
| 11-4 | 198 | 0.21 | 0.19 | 15.0 |
| 12-1 | *168-310 | 0.22 | 0.20 | 182 |
| 12-2 | *168-310 | 0.17 | 0.27 | 164 |
| 12-3 | *168-310 | 0.16 | 0.25 | 115 |
| 12-4 | *168-310 | 0.18 | 0.27 | 121 |
| 13-1 | *170-209 | 0.14 | 0.28 | 12.7 |
| 13-2 | *170-209 | 0.17 | 0.25 | 9.7 |
| 13-3 | *170-209 | 0.15 | 0.22 | 10.9 |
| 13-4 | *170-209 | 0.19 | 0.22 | 7.5 |
| 14-1 | *190-280 | 0.16 | 0.21 | 7.4 |
| 14-2 | *190-280 | — | 0.27 | 3.7 |
| 14-3 | *190-280 | 0.13 | 0.26 | 2.1 |

TABLE VIII-continued

| Cathode | Test Time (Hours) | $\eta H_2V$ | $R(\Omega/cm^2)$ | Wt. Loss (mg) |
|---|---|---|---|---|
| 14-4 | *190–280 | 0.19 | 0.21 | 3.7 |

* = in the range of

TABLE IX

| Time, hrs | $V_{cell}$, volts Ni | 20-1 | 20-2 | 20-3 | 20-4 |
|---|---|---|---|---|---|
| 0 | 2.155 | 2.116 | 2.095 | 1.998 | 1.997 |
| 18 | 2.138 | 2.059 | 2.106 | 1.955 | 1.968 |
| 21 | 2.244 | 2.045 | 2.088 | 1.953 | 1.955 |
| 24 | 2.235 | 2.050 | 2.092 | 1.968 | 1.961 |
| 42 | 2.382 | 2.065 | 2.130 | 1.965 | 1.967 |
| 45 | 2.395 | 2.064 | 2.138 | 1.963 | 1.968 |
| 48 | 2.406 | 2.075 | 2.135 | 1.963 | 1.975 |
| 66 | 2.450 | 2.080 | 2.147 | 1.967 | 1.980 |
| 72 | 2.542 | 2.091 | 2.174 | 1.979 | 1.984 |
| 162 | 2.458 | 2.085 | 2.184 | 1.974 | 1.981 |
| 168 | 2.450 | 2.102 | 2.200 | 1.985 | 1.986 |
| 186 | 2.406 | 2.045 | 2.184 | 1.970 | 1.973 |

The data in Tables VIII and IX confirm that the best cathodes are generally obtained when the plasma sprayed substrate having $AB_N$ intermetallic compound in the sprayed coating is reduced, particularly in hydrogen at a temperature in the vicinity of 500° C.

While in accordance with the provisions of the statute, there is illustrated and described herein specific embodiments of the invention, those skilled in the art will understand that changes may be made in the form of the invention covered by the claims and certain features of the invention may sometimes be used to advantage without a corresponding use of the other features.

I claim:

1. A process for producing a hydrogen evolution cathode comprising spraying particles of a powder containing an $AB_N$ intermetallic compound wherein A is at least one member of the group consisting of rare earth elements and calcium and up to 0.2 atom of zirconium and/or thorium, B is selected from the group of nickel and cobalt and up to 1.5 atom in total of aluminum, copper, tin, iron and chromium and N has a value between 4 and 8, through an energetic medium onto a metallic substrate characterized by corrosion resistance in aqueous alkaline media, the duration of the spray passage and the temperature of said medium being such that particles of said powder are at least partly molten at time of impact with said substrate, and thereafter subjecting the thus sprayed substrate to a reduction at a temperature up to about 650° C. to reduce the coating on said substrate.

2. A process as in claim 1 wherein the energetic medium is a plasma.

3. A process as in claim 1 wherein the energetic medium is a flame.

4. A process as in claim 1 wherein the powder containing $AB_N$ intermetallic compound also contains up to about 60 weight percent powders of a metal from the group of iron, nickel, iron alloys and nickel alloys.

5. A process as in claim 1 wherein the substrate is made of a metal from the group of nickel, nickel alloys, iron, iron alloys and nickel-coated iron.

6. A process as in claim 1 wherein the reduction is carried out by subjecting the spray-coated substrate to flowing gaseous hydrogen at essentially atmospheric pressure for time and temperature conditions equivalent to about 30 minutes at 500° C.

* * * * *